US009024986B2

(12) United States Patent
Roth et al.

(10) Patent No.: US 9,024,986 B2
(45) Date of Patent: May 5, 2015

(54) DUAL-SIDED THERMAL PHARMACY SCRIPT PRINTING

(75) Inventors: Joseph D. Roth, Springboro, OH (US); Wendell B. Halbrook, Waynesville, OH (US); Maryann Wehr, Hamilton, OH (US); Michael J. VanDemark, Springboro, OH (US)

(73) Assignee: NCR Corporation, Duluth, GA (US)

( * ) Notice: Subject to any disclaimer, the term of this patent is extended or adjusted under 35 U.S.C. 154(b) by 2058 days.

(21) Appl. No.: 11/503,326

(22) Filed: Aug. 11, 2006

(65) Prior Publication Data

US 2007/0211094 A1 Sep. 13, 2007

Related U.S. Application Data

(60) Provisional application No. 60/779,781, filed on Mar. 7, 2006, provisional application No. 60/779,782, filed on Mar. 7, 2006.

(51) Int. Cl.

| | |
|---|---|
| ***B41J 3/60*** | (2006.01) |
| ***B41J 2/32*** | (2006.01) |
| ***B41J 11/46*** | (2006.01) |

(52) U.S. Cl.
CPC .... *B41J 2/32* (2013.01); *B41J 3/60* (2013.01); *B41J 11/46* (2013.01)

(58) Field of Classification Search
USPC ..... 347/171, 221; 400/82, 120.01, 188
See application file for complete search history.

(56) References Cited

U.S. PATENT DOCUMENTS

| | | | |
|---|---|---|---|
| 3,466,423 | A | 9/1969 | Janning |
| 3,518,406 | A | 6/1970 | Janning |
| 3,663,390 | A | 5/1972 | Fergason et al. |
| 3,947,854 | A | 3/1976 | Hansen et al. |
| 4,161,277 | A | 7/1979 | Steiner |
| 4,167,392 | A | 9/1979 | Defago |
| RE30,116 | E | 10/1979 | Maalouf |
| 4,309,255 | A | 1/1982 | Gendler et al. |
| 4,507,669 | A | 3/1985 | Sakamoto et al. |
| 4,631,596 | A | 12/1986 | Yaguchi |
| 4,708,500 | A | 11/1987 | Bangs et al. |
| 4,806,950 | A | 2/1989 | Sekine et al. |
| 4,853,256 | A | 8/1989 | Obringer et al. |
| 4,924,275 | A | 5/1990 | Nelson |

(Continued)

FOREIGN PATENT DOCUMENTS

| | | |
|---|---|---|
| AT | 397 636 | 5/1994 |
| CN | 1065536 A | 2/1992 |

(Continued)

OTHER PUBLICATIONS

Computer-generated translation of JP 2000-315275, published on Nov. 2000.*

(Continued)

*Primary Examiner* — Huan Tran
(74) *Attorney, Agent, or Firm* — Joseph P. Mehrle; Michael Chan

(57) ABSTRACT

There is provided a method for imaging a dual-sided thermal media. The method includes detecting one or more sense marks disposed on the thermal media and controlling activation of one or more of a first print head and a second print head to image a respective one or more of a first side and a second side of the thermal media based on the detection.

38 Claims, 7 Drawing Sheets

(56) References Cited

U.S. PATENT DOCUMENTS

| | | | | |
|---|---|---|---|---|
| 4,956,251 | A | 9/1990 | Washizu et al. | |
| 4,965,166 | A | 10/1990 | Hosoi et al. | |
| 4,987,118 | A | 1/1991 | Murata et al. | |
| 5,055,373 | A | 10/1991 | Saeki et al. | |
| 5,101,222 | A | 3/1992 | Hakkaku | |
| 5,130,292 | A * | 7/1992 | Ito et al. | 503/227 |
| 5,132,704 | A | 7/1992 | Nakagawa | |
| 5,196,297 | A | 3/1993 | Dombrowski, Jr. et al. | |
| 5,214,750 | A | 5/1993 | Minowa et al. | |
| 5,219,821 | A | 6/1993 | Arbee et al. | |
| 5,266,550 | A | 11/1993 | Asajima et al. | |
| 5,272,127 | A | 12/1993 | Mandoh et al. | |
| 5,284,816 | A * | 2/1994 | Stephenson | 503/227 |
| 5,319,392 | A | 6/1994 | Durst et al. | |
| 5,339,099 | A | 8/1994 | Nureki et al. | |
| 5,366,952 | A | 11/1994 | Granquist | |
| 5,398,305 | A | 3/1995 | Yawata et al. | |
| 5,428,714 | A | 6/1995 | Yawata et al. | |
| 5,437,004 | A | 7/1995 | Miyasaka et al. | |
| 5,476,698 | A | 12/1995 | Denny | |
| 5,537,550 | A | 7/1996 | Russell et al. | |
| 5,555,349 | A | 9/1996 | Miyasaka et al. | |
| 5,584,590 | A | 12/1996 | Ito et al. | |
| 5,585,321 | A | 12/1996 | Breen et al. | |
| 5,594,653 | A | 1/1997 | Akiyama et al. | |
| 5,629,259 | A | 5/1997 | Akada et al. | |
| 5,639,169 | A | 6/1997 | Aruga | |
| 5,667,303 | A | 9/1997 | Arens et al. | |
| 5,677,722 | A | 10/1997 | Park | |
| 5,686,159 | A | 11/1997 | Langan | |
| 5,688,057 | A | 11/1997 | Wright et al. | |
| 5,692,110 | A | 11/1997 | Miyasaka et al. | |
| 5,707,925 | A | 1/1998 | Akada et al. | |
| 5,710,094 | A | 1/1998 | Minami et al. | |
| 5,727,135 | A | 3/1998 | Webb | |
| 5,741,592 | A | 4/1998 | Lewis et al. | |
| 5,754,213 | A | 5/1998 | Whritenor | |
| 5,755,521 | A | 5/1998 | Ito et al. | |
| 5,756,188 | A | 5/1998 | Reiter et al. | |
| 5,763,356 | A | 6/1998 | Ueno et al. | |
| 5,769,457 | A * | 6/1998 | Warther | 283/61 |
| 5,781,823 | A | 7/1998 | Isobe et al. | |
| 5,789,340 | A | 8/1998 | Brust et al. | |
| 5,792,725 | A | 8/1998 | Simpson et al. | |
| 5,794,530 | A | 8/1998 | Dobashi et al. | |
| 5,800,081 | A | 9/1998 | Teradaira et al. | |
| 5,815,191 | A | 9/1998 | Michielsen et al. | |
| 5,846,900 | A | 12/1998 | Reiter et al. | |
| 5,876,836 | A | 3/1999 | Imamura et al. | |
| 5,883,043 | A | 3/1999 | Halbrook, Jr. et al. | |
| 5,886,725 | A | 3/1999 | Miyadera et al. | |
| 5,918,910 | A | 7/1999 | Stillwagon et al. | |
| 5,961,228 | A | 10/1999 | Ward et al. | |
| 5,964,541 | A | 10/1999 | Murison et al. | |
| 5,980,128 | A | 11/1999 | Verlinden et al. | |
| 6,000,726 | A | 12/1999 | Campbell | |
| 6,000,867 | A | 12/1999 | Yoshii et al. | |
| 6,042,264 | A | 3/2000 | Prusik et al. | |
| 6,095,414 | A | 8/2000 | Long et al. | |
| 6,106,910 | A | 8/2000 | Tan et al. | |
| 6,118,956 | A | 9/2000 | Hirao | |
| 6,130,185 | A | 10/2000 | Narita et al. | |
| 6,150,067 | A | 11/2000 | Koike et al. | |
| 6,151,037 | A | 11/2000 | Kaufman | |
| 6,165,937 | A | 12/2000 | Puckett et al. | |
| 6,197,722 | B1 | 3/2001 | Irving et al. | |
| 6,210,517 | B1 | 4/2001 | Eadara et al. | |
| 6,210,777 | B1 | 4/2001 | Vermeulen et al. | |
| 6,233,057 | B1 | 5/2001 | Ota | |
| 6,241,386 | B1 | 6/2001 | Limburg et al. | |
| 6,258,746 | B1 | 7/2001 | Mehta | |
| 6,267,052 | B1 | 7/2001 | Hill et al. | |
| 6,350,072 | B1 | 2/2002 | Nunes et al. | |
| 6,388,692 | B1 | 5/2002 | Iwata et al. | |
| 6,416,154 | B1 | 7/2002 | Silverbrook | |
| 6,523,951 | B2 | 2/2003 | Takeya et al. | |
| 6,524,000 | B1 | 2/2003 | Roth | |
| 6,543,808 | B1 | 4/2003 | Mitchell, Jr. et al. | |
| 6,544,709 | B1 | 4/2003 | Wang et al. | |
| 6,544,925 | B1 | 4/2003 | Prusik et al. | |
| 6,562,755 | B1 | 5/2003 | Halbrook, Jr. et al. | |
| 6,663,304 | B2 | 12/2003 | Vives et al. | |
| 6,705,786 | B2 | 3/2004 | Trovinger | |
| 6,737,137 | B2 | 5/2004 | Franko, Sr. et al. | |
| 6,759,366 | B2 | 7/2004 | Beckerdite et al. | |
| 6,784,906 | B2 | 8/2004 | Long et al. | |
| 6,786,263 | B1 | 9/2004 | Fox, Jr. et al. | |
| 6,801,233 | B2 | 10/2004 | Bhatt et al. | |
| 6,803,344 | B2 | 10/2004 | Halbrook et al. | |
| 6,812,943 | B1 | 11/2004 | Day et al. | |
| 6,906,735 | B2 | 6/2005 | Bhatt et al. | |
| 6,962,449 | B2 | 11/2005 | Lermant et al. | |
| 6,962,763 | B2 | 11/2005 | Maskasky et al. | |
| 6,982,737 | B2 | 1/2006 | Elko et al. | |
| 7,192,904 | B2 | 3/2007 | Iwasaki et al. | |
| 7,514,262 | B2 | 4/2009 | Ribi | |
| 7,520,586 | B2 | 4/2009 | Itoh | |
| 7,589,752 | B2 | 9/2009 | Janning | |
| 7,623,145 | B2 | 11/2009 | Taguchi | |
| 7,671,878 | B2 | 3/2010 | Yamada et al. | |
| 7,760,370 | B2 | 7/2010 | Oki | |
| 2001/0034775 | A1 | 10/2001 | Minowa | |
| 2002/0122188 | A1 | 9/2002 | Elko et al. | |
| 2002/0124950 | A1 | 9/2002 | Klima | |
| 2003/0025779 | A1 | 2/2003 | Miyazaki | |
| 2003/0031861 | A1 | 2/2003 | Reiter et al. | |
| 2003/0112318 | A1 | 6/2003 | Long et al. | |
| 2003/0208560 | A1 | 11/2003 | Inoue et al. | |
| 2004/0046971 | A1 | 3/2004 | Lapstun et al. | |
| 2004/0084631 | A1 | 5/2004 | Spoonhower et al. | |
| 2004/0135872 | A1 | 7/2004 | Burdenko | |
| 2004/0265542 | A1 | 12/2004 | Yanagisawa et al. | |
| 2005/0020387 | A1 | 1/2005 | Kennedy, III | |
| 2005/0031392 | A1 | 2/2005 | Yamamoto et al. | |
| 2005/0146739 | A1 | 7/2005 | Rayl et al. | |
| 2005/0146740 | A1 | 7/2005 | Fukuda | |
| 2005/0148467 | A1 | 7/2005 | Makitalo et al. | |
| 2005/0164881 | A1 | 7/2005 | Kenney et al. | |
| 2005/0271866 | A1 | 12/2005 | Lee | |
| 2006/0072001 | A1 | 4/2006 | Klein | |
| 2006/0289633 | A1 | 12/2006 | Moreland et al. | |
| 2007/0109349 | A1 | 5/2007 | Tanaka et al. | |
| 2007/0207926 | A1 | 9/2007 | VanDemark et al. | |
| 2007/0223022 | A1 | 9/2007 | Suzuki | |
| 2009/0184510 | A1 | 7/2009 | Frankel | |
| 2009/0195584 | A1 | 8/2009 | Itoh | |
| 2009/0225353 | A1 | 9/2009 | Ishibashi | |
| 2010/0225932 | A1 | 9/2010 | Kurose et al. | |

FOREIGN PATENT DOCUMENTS

| | | |
|---|---|---|
| EP | 0552956 | 7/1993 |
| EP | 0947340 | 10/1999 |
| EP | 1 862 318 | 5/2007 |
| EP | 1 862 319 | 5/2007 |
| GB | 2 250 478 | 6/1992 |
| JP | 58-008668 | * 1/1983 |
| JP | 58051172 | 3/1983 |
| JP | JP 62-178381 | * 8/1987 |
| JP | 03234560 | 10/1991 |
| JP | 03293171 | 12/1991 |
| JP | H07-061141 | 8/1993 |
| JP | 6-262786 | * 9/1994 |
| JP | H09-086041 | 9/1995 |
| JP | 08-127152 | 5/1996 |
| JP | 08-169127 | 7/1996 |
| JP | 09-183427 | 7/1997 |
| JP | 2000315275 | 11/2000 |
| JP | 2001080131 | 3/2001 |
| JP | 2001-199095 | 7/2001 |
| JP | 2003-251595 | 9/2003 |
| JP | 09-183427 | 9/2004 |
| JP | 2006-095755 | 4/2006 |
| JP | 2006-256289 | 9/2006 |

(56) References Cited

FOREIGN PATENT DOCUMENTS

| | | | |
|---|---|---|---|
| RU | 2088969 | | 8/1997 |
| WO | WO 85/04842 | * | 11/1985 |
| WO | 02/096665 | | 12/2002 |
| WO | 2004/077001 | A1 | 9/2004 |
| WO | 2004077001 | A1 | 9/2004 |
| WO | 2007/102879 | | 9/2007 |
| WO | 2007102879 | | 9/2007 |

OTHER PUBLICATIONS

JP Abstract, vol. 007,No. 063 (M-200), Mar. 16, 1983 & JP 57-208298 A (Ricoh KK), Dec. 21, 1982.
JP Abstract, vol. 007, No. 081 (M-105), Apr. 5, 1983 & JP 58-008668 A (Shinko Denki KK), Jan. 18, 1983.
JP Abstract, vol. 015, No. 194 (M-1114), May 20, 1991 & JP 03/051149 A (Fujitsu General Ltd.), Mar. 5, 1991.
JP Abstract, vol. 2000, No. 24, May 11, 2001 & JP 2001-199095 A (Alps Electric Co. Ltd.), Jul. 24, 2001.
JP Abstract, vol. 1998, No. 08, Jun. 30, 1998 & JP 10-076713 A (Sony Corp.), Mar. 24, 1998.
JP Abstract, vol. 010, No. 151 (M-483), May 31, 1986 & JP 61-003765 A (Konishiroku Shashin Kogyo KK), Jan. 9, 1986.
JP Abstract, vol.016, No. 041 (M-1206), Jan. 31, 1992 & JP 03-246091 A (Canon Inc.), Nov. 1, 1991.
Boca Systems Micro Plus 2S 2 Sided Printer product brochure which came to the attention of Applicant at a Chicago tradeshow during the summer of 2002.
"International Search Report for corresponding PCT Application No. PCT/US2006/033680", (Feb. 27, 2007), 3 pgs.
"Written Opinion of the International Searching Authority for the corresponding PCT Application No. PCT/US2006/033680", (Feb. 27, 2007), 3 pgs.
APTi PowerEcoT R2412 printer brochure.
APTi PowerEcoT R2412 printer brochure, which came to Applicant's attention in the summer of 2007 and was translated by Applicant's Japanese Office in the fall of 2007.

* cited by examiner

DUAL-SIDED THERMAL PHARMACY SCRIPT PRINTING

CROSS REFERENCE TO RELATED APPLICATIONS

This application claims priority to U.S. Provisional Application No. 60/779,781 entitled "Two-Sided Thermal Printing" and filed on Mar. 7, 2006, and U.S. Provisional Application No. 60/779,782 entitled "Dual-Sided Thermal Printer" and filed on Mar. 7, 2006; the disclosures of which are hereby incorporated by reference herein.

TECHNICAL FIELD

This disclosure relates to direct thermal printers. More particularly, example embodiments are directed to a dual-sided thermal media, a dual-sided thermal printer, a dual-sided direct thermal printing system and a method for imaging a dual-sided thermal media.

BACKGROUND

Desktop cut-sheet laser printers have been commonly used in the retail pharmacy industry to print scripts (i.e., booklets or pamphlets) in support of prescription fills. Processing these documents is time consuming, wasteful and unreliable using the cut-sheet laser printers, as sheet skew, page jams, and mis-feeds are common problems associated with the cut-sheet laser printers, especially when printing in duplex mode, (i.e., on both sides of the sheet). In addition, the cut-sheet desktop laser printers typically rely upon fixed-length sheets (e.g., letter size—8½"×11" and legal size—8½"×14") to print variable amounts of data. As such, fixed-length sheets usually have a limited amount of space available for variable data printing. This necessarily leads to an increase in sheet consumption, as full sheets are used to print partial amounts of data. Finally, as the sheets for each script and for the scripts of the different prescription fills are printed on separate sheets, there is a great possibility for misplacement and loss of the sheets, as well as increase in probability that the sheets may end up in the wrong hands. The latter is of concern as the scripts may contain personal and/or confidential information.

Direct thermal printers are used in many applications. Often, information is provided or printed only on one side of a document or a receipt. Dual-sided direct thermal printing of documents, such as transaction documents and receipts, is described in U.S. Pat. Nos. 6,784,906 and 6,759,366. In dual-sided direct thermal printing, the printer is configured to allow concurrent printing on both sides of a thermal media moving along a feed path through the thermal printer. In such a printer, a direct thermal print head is disposed on each side of the thermal media along the feed path. In operation, each thermal print head faces an opposing platen across the thermal media from the respective print head. During printing, the opposing print heads selectively apply heat to the opposing sides of the thermal media, which comprises a substrate with a thermally sensitive coating on each of the opposing surfaces of the substrate. The coating changes color when heat is applied, such that printing is provided on the coated substrate.

As the reliability and efficiency of script printing are of critical importance in pharmacy applications, there is a need in the art for providing a dual-sided thermal media and a dual-sided thermal printer to image pharmacy scripts.

SUMMARY

In accordance with an embodiment, there is provided a method for imaging a dual-sided thermal media, the method comprising: detecting one or more sense marks disposed on the thermal media; and controlling activation of one or more of a first print head and a second print head to image a respective one or more of a first side and a second side of the thermal media based on the detection.

In accordance with another embodiment, there is provided a dual-sided direct thermal printer comprising: a first print head positioned proximate to a first platen; a second print head positioned proximate to a second platen, the first print head being in a substantially opposed relation to the second platen and the second print head being in a substantially opposed relation to the first platen; and a sensor adapted to detect one or more sense marks disposed on a thermal media and to control activation of one or more of the first print head and the second print head to image the thermal media based on the detection.

In accordance with yet another embodiment, there is provided a thermal media for dual-sided imaging, the thermal media comprising: a plurality of successive parts of a predetermined length and a predetermined width, the successive parts delineated by a plurality of cross perforations along the predetermined width; and a plurality of sense marks, each of the plurality of sense marks disposed at a predetermined location of a respective part of the plurality of successive parts.

In accordance with a further embodiment, there is provided a dual-sided direct thermal printing system, the system comprising: a thermal media for dual-sided imaging including: a plurality of successive parts of a predetermined length and a predetermined width, the successive parts delineated by a plurality of cross perforations along the predetermined width; and a plurality of sense marks, each of the plurality of sense marks disposed at a predetermined location of a respective part of the plurality of successive parts; and a dual-sided thermal printer including: a first print head positioned proximate to a first platen; a second print head positioned proximate to a second platen, the first print head being in a substantially opposed relation to the second platen and the second print head being in a substantially opposed relation to the first platen; and a sensor adapted to detect the plurality of sense marks disposed on the thermal media and to control activation of one or more of the first print head and the second print head to image one or more of the successive parts of the thermal media based on the detection.

BRIEF DESCRIPTION OF THE DRAWINGS

Various features and attendant advantages of the example embodiments will be more fully appreciated as the same becomes better understood when considered in conjunction with the accompanying drawings, in which like reference characters designate the same or similar parts throughout the several views, and wherein.

DETAILED DESCRIPTION

Figure 1:
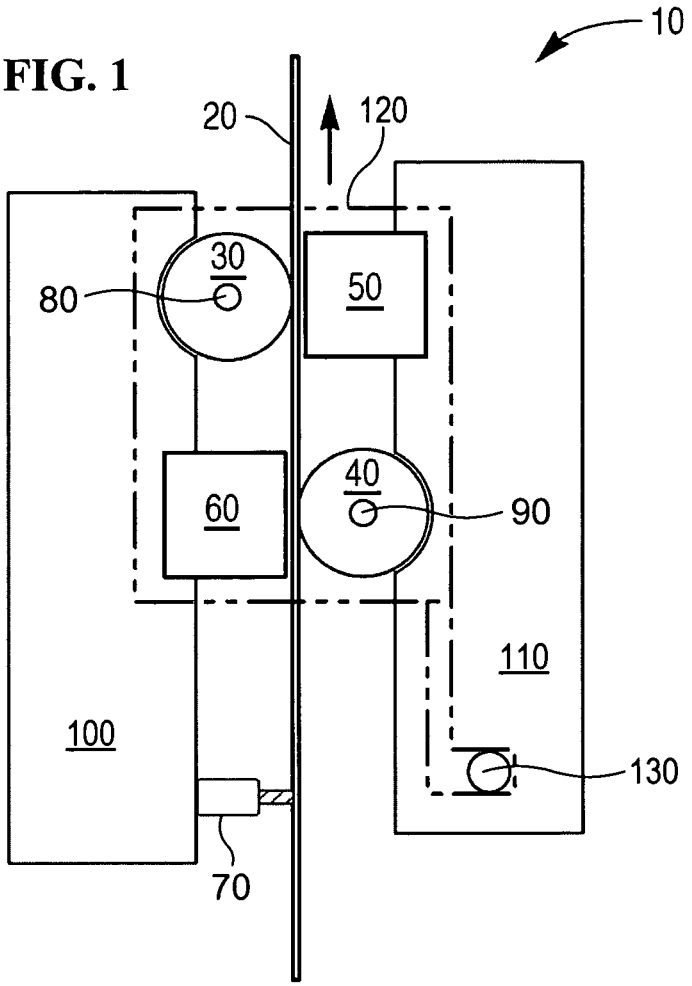
FIG. 1 illustrates a schematic of an example dual-sided imaging direct thermal printer.

FIG. 1 illustrates a schematic of an example dual-sided imaging direct thermal printer 10 useable for dual-sided printing of thermal print media 20 to produce a variable length pharmacy script (i.e., "document"). It is to be noted that printer 10 may print a variety of other documents such as vouchers, coupons, receipts or tickets. Thermal printer 10 comprises support arms 100 and 110. Second support arm 110 may be journaled on an arm shaft 130 to permit arm 110 to pivot or rotate in relation to arm 100. The support arms 100 and 110 may also be in a fixed relation to one another. Thermal printer 10 further comprises platens 30 and 40 and opposing thermal print heads 50 and 60 on opposite sides of the thermal print media 20. More specifically, first support arm 100 comprises a first platen 30 and a first print head 60, and the second support arm 110 comprises a second platen 40 and a second print head 50. The platens 30 and 40 are substantially cylindrical in shape. The first platen 30 may be journaled on a first shaft 80 and the second platen 40 may be journaled on a second shaft 90. Each of shafts 80 and 90 are coupled to the support arms 100 and 110, respectively. Platens 30 and 40 are further rotatable via drive assembly 120 about shafts 80 and 90, respectively, for moving thermal print media 20 through the printer 10. The drive assembly 120 comprises a motor (not shown) for powering a system of gears, links, cams, and combinations thereof. The first and second print heads 50 and 60 may be any print heads suitable for direct thermal printing, such as those disclosed in U.S. Pat. Nos. 3,947,854; 4,708,500; and 5,964,541. Thermal printer 10 further comprises a sensor 70 for detecting one or more predetermined sense marks on the print media 20 as it is moved through the thermal printer 10. The sensor 70 may be an optical sensor, such as a transmissive or a reflective sensor. It may further employ a variety of light sources for detection, e.g., infrared, visible red, blue-green and the like. The sensor 70 may also have a fine, medium or course focal point or aperture for detecting the one or more predetermined sense marks on the print media 20. The focal point or the aperture used may be selected based on the particular dimensions of the one or more predetermined sense marks, which are elucidated in greater detail below with reference to FIG. 2A. Although only senor 70 is shown for brevity and clarity, it is noted that a plurality of sensors 70, or other types of sensors, such as electrical sensors, mechanical sensors, and the like, may be provided for detecting sense marks on the print media 20. Further, additional sensors may be provided for determining various conditions to control the operation of the thermal printer 10, such as a media sensor to detect a paper out condition.

With further reference to FIG. 1, thermal printer 10 operates on thermal print media 20, which may be supplied in the form of a continuous paper roll or a continuous fan-folded stack and upon which features such as graphics or text, and combinations thereof may be printed on one or both sides thereof, to provide the printed document, such as for example, the pharmacy script, or any other articles or documents described hereinabove. Thermal print media 20 for printing pharmacy scripts will be described in greater detail with reference to FIGS. 2A-2B. Thermal print media 20 may be a double-sided thermal paper, e.g., comprising a cellulosic or polymer substrate sheet coated on each side with heat sensitive dyes as described in U.S. Pat. Nos. 6,784,906 and 6,759,366; the contents of which are incorporated by reference herein. Dual-sided direct thermal printing may be facilitated by, for example, thermal print media 20, which includes dyes on opposite sides of the print media 20, and a sufficiently thermally resistant substrate that inhibits thermal printing on one side of the print media 20 from affecting thermal printing on the opposite side of print media 20.

With final reference to FIG. 1, the dual-sided direct thermal printing of the print media 20 may be accomplished in a single pass process. Alternately, dual-sided direct thermal printing may be accomplished in a process where the media 20 may be imaged by one or both of the thermal print heads 50 and 60 when moving in a first direction, and then retracted for further imaging by the one or both thermal print heads 50 and 60 with the media moving in either the first or the second, retract direction. Once printing is completed, the print media 20 may be manually or automatically cut or detached to form the printed document, which is elucidated in greater detail below with reference to FIGS. 2A-2B. In situations where the printed document is a pharmacy script, the detached portion of the print media 20 may be fan-folded into a booklet or pamphlet, which is also elucidated in greater detail below with reference to FIGS. 3A-3B.

Figure 2A:
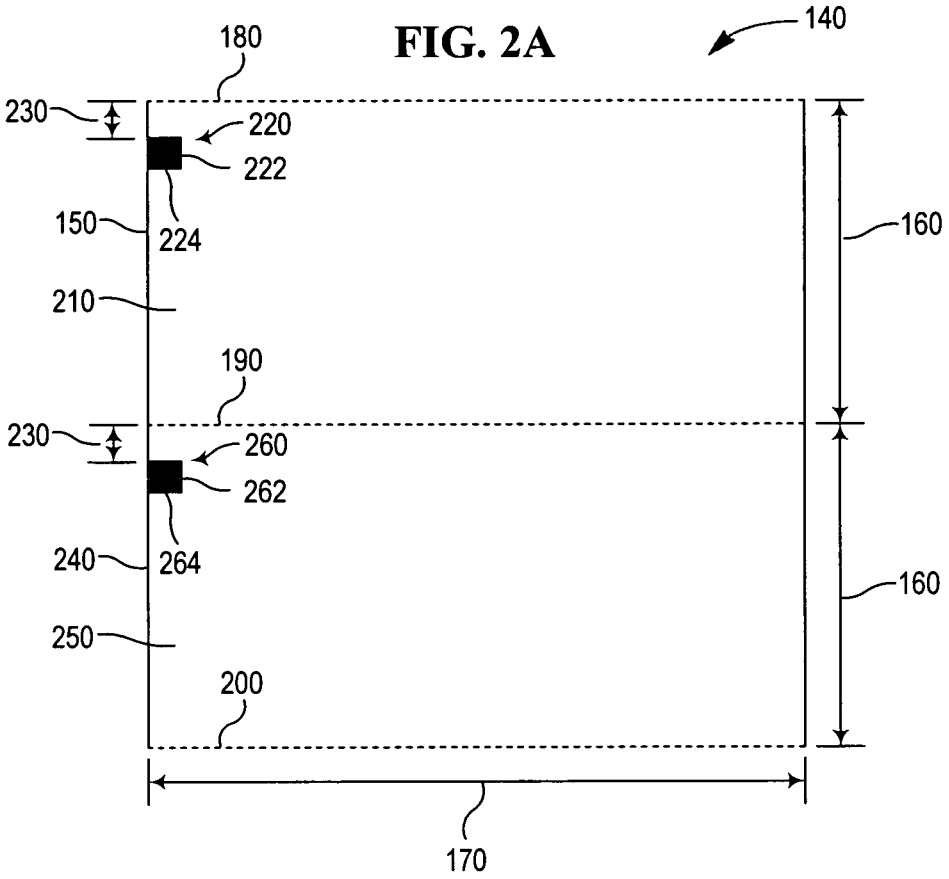
FIGS. 2A-2B illustrate an example first side and an example second side, respectively, of a portion of a dual-sided thermal print media for printing a pharmacy script using the example dual-sided imaging direct thermal printer, in accordance with FIG. 1.

FIG. 2A illustrates an example first side 140 of a portion of the dual-sided thermal print media 20 for printing a pharmacy script using the example dual-sided imaging direct thermal printer 10, in accordance with FIG. 1. As was described hereinabove with reference to FIG. 1, thermal print media 20 may be supplied in a continuous thermal print media roll or a continuous fan-folded stack for printing pharmacy scripts using the dual-sided imaging direct thermal printer 10. It is to be noted that the example portion illustrated in FIG. 1 is representative of the thermal print media roll or the fan-folded print media stack.

Further with reference to FIG. 2A, parts 150 and 240, which are delineated by cross perforations 180, 190, 200, are representative of the continuous paper roll or the a continuous paper stack. More specifically, the continuous thermal print media roll or print media stack comprises a multiplicity of parts, such as parts 150 and 240. Each of the 150 and 240 has a predetermined length 160 and a predetermined width 170. The predetermined length 160 may be about 5½ inches and the predetermined width 170 may be about 8½ inches, in which case the combined parts 150 and 240 that form first side 140 are equivalent to a size of about 8½ inches by about 11 inches. The range of the predetermined length 160 may be from about 3 inches to about 14 inches and the range of the predetermined width 170 may be from about 3 inches to about 8½ inches. It is noted that the predetermined length 160 and predetermined width 170 of each of the parts 150 and 240 may be selected based on particular size requirements of a pharmacy script (e.g., letter, legal, and the like).

Still further reference to FIG. 2A, part 150 may be delineated by cross perforation 180 along the width of the top edge and by cross perforation 190 along the width of the bottom edge. Part 240 may be delineated by cross perforation 190 along the width of its top edge and by cross perforation 200 along the width of its bottom edge. Parts 150 and 240 further comprise respective imaging or printing surfaces 210 and 250 for imaging graphics, text and/or combinations thereof. Imaging surfaces 210 and 250 comprise respective sense marks 220 and 260 for detection by the sensor 70 of printer 10. It is to be noted that the thermal print media 20 may be positioned in the printer 10 with the sense marks 220 and 260 facing the sensor 70. Each of the sense marks 220 and 260 has a respective predetermined length 222, 262 and a respective predetermined width 224, 264 to enable detection by the sensor 70. An example sense mark may be a square with each of the predetermined length 222, 262 and the predetermined width 224, 264 equal to about ¼ of inch. The range of the predetermined length 222, 262 may be from about 0.10 of inch to about ¼ of inch, and the range of the predetermined width 224, 264 may be from about 0.10 of an inch to about 1 inch, although other lengths are possible. Furthermore, the sense marks 220 and 260 may be positioned or disposed in coincidence with the left edge of the first side 140, and at a predetermined distance 230 from the respective top edge perforations 180 and 190. The predetermined distance 230 may be about ¼ of inch. Alternate positions and distances, as well as additional sense marks on each part 150 and 240, may easily be employed based on particular requirements.

Lastly with reference to FIG. 2A, the formation of the sense marks (e.g., sense marks 220 and 260) and cross perforations (e.g., 180, 190, 200) on the dual-sided thermal print media 20 are described. The formation of the sense marks and the cross perforations may follow the manufacturing process of the thermal print media 20 that is described in U.S. Pat. No. 6,784,906, which is incorporated by reference herein. The sense marks and the cross perforations may be formed concurrently via a media converting process, which prints the sense marks and registers the cross perforations to the respective sense marks. In an embodiment, the media converting process may utilize a printing press to print the sense marks on the thermal print media 20 and to form the cross perforations, registering the cross perforations to the respective sense marks. The printing press may employ lithographic, ultra violet lithographic, or flexographic printing. Other printing methods, such as the gravure method, may also be employed in the media converting process. In another embodiment, the media converting process may also utilize thermal printing techniques to image the sense marks in combination with the registration of the cross perforations to the respective sense marks. In a further embodiment, the media converting process may create sense marks in the form of holes, slits, perforations and the like in the thermal print media 20. Alternately, the media converting process may create sense marks in the form of raised dimples, ridges and the like. Concurrent formation of the sense marks and the cross perforations ensures integrity or precise registration between the sense marks and cross perforations. In one embodiment, the cross perforations may be used as the sense marks.

Figure 2B:
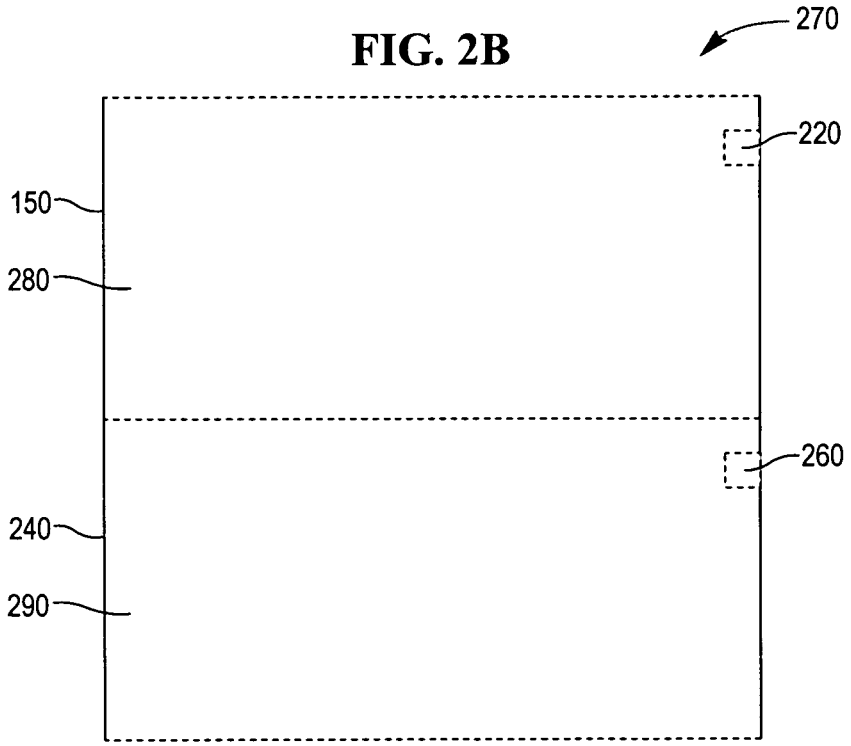

FIG. 2B illustrates an example second reverse side 270 of a portion of the dual-sided thermal print media 20 for printing a pharmacy script using the example dual-sided imaging direct thermal printer 10, in accordance with FIG. 1. Parts 150 and 240 on the second side 270 comprise respective imaging or printing surfaces 280 and 290 for imaging graphics, text and a combination thereof. Although no sense marks are positioned or disposed in coincidence with the left edge of the second side 270, depending on the particular requirements, such sense marks may be provided on the second side 270 as well. This may accommodate the placement of the thermal print media 20 with the first side 140 or the second side 270 facing sensor 70. However, when the pharmacy script is fan-folded, sense marks on one of the first side 140 and the second side 270 may be visible on the outside of the pharmacy script. As such, sense marks are provided on one side so that they may be fan-folded to the interior once the pharmacy script is printed. Therefore, sense marks 220 and 260 disposed on the first side 140 are shown on the second side 270 with dashes for reference purposes.

Figure 3A:
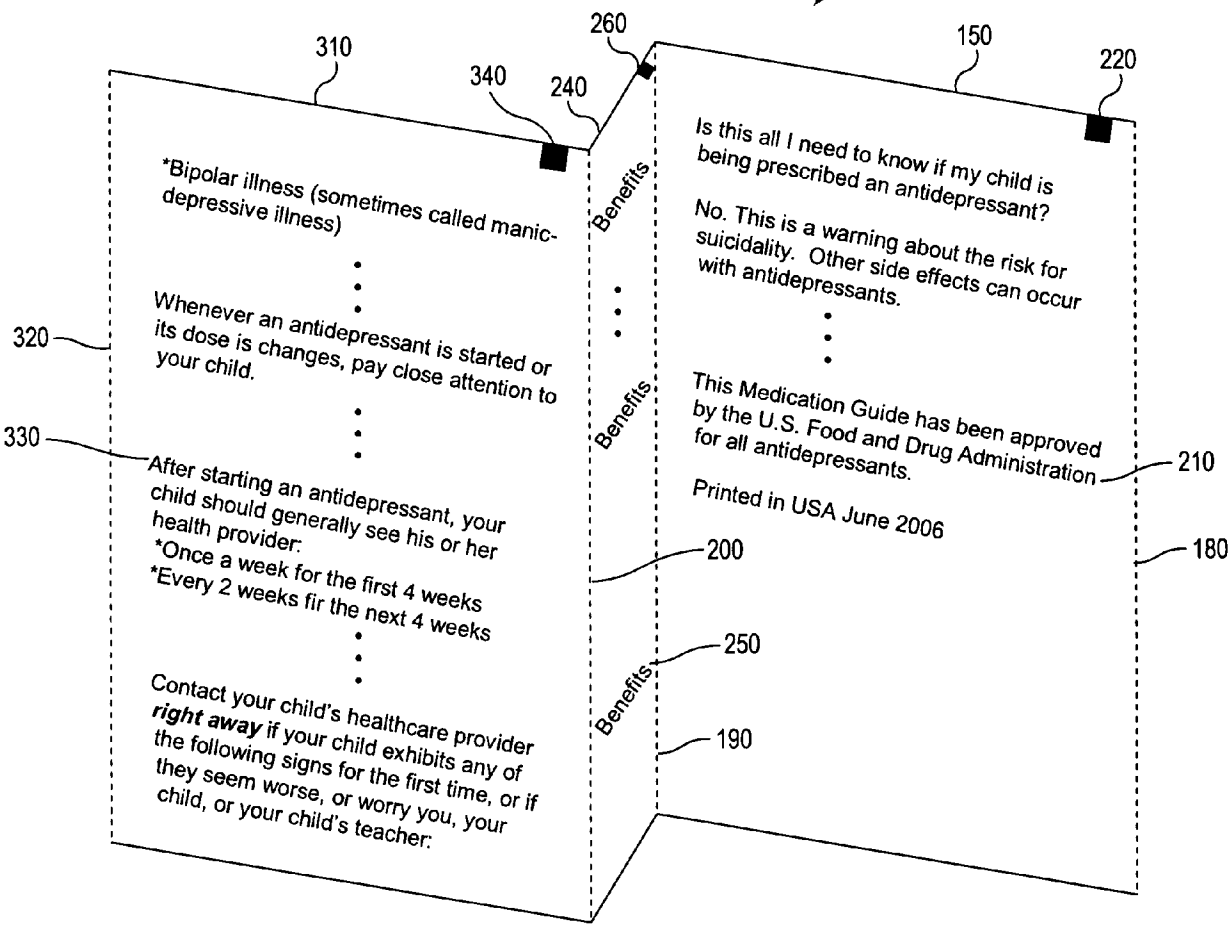
FIGS. 3A-3B illustrate an example first side and an example second side, respectively, of an example pharmacy script printed using the dual-sided imaging direct thermal printer and dual-sided thermal print media, in accordance with FIGS. 1 and 2A-2B.

FIG. 3A illustrates an example first side 300 of an example pharmacy script printed using the dual-sided imaging direct thermal printer 10 and the dual-sided thermal print media 20, in accordance with FIGS. 1 and 2A-2B. The example pharmacy script of FIG. 3A comprises three parts 150, 240 and 310, which include respective imaging or printing surfaces 210, 250 and 330. Each of the printing surfaces 210, 250 and 330 may be imaged or printed with graphics, text and/or combinations thereof. Once printed or imaged, a portion of the thermal print media 20 is detached or cut at the last printed part 310 via a cross perforation (or cut) 320 along the width of the lower edge of the last part 310. The detached portion may then be fan-folded along cross perforations 190 and 200 into a pharmacy script, with sense marks 220 and 260 fan-folded to the interior of the pharmacy script. It is noted, that the last sense mark 340 may still be visible when the pharmacy script is folded, as there are an uneven number of parts 220, 240 and 310. It should further be noted that any drug-related information that must be concealed in accordance with federal law may be printed or imaged on printing or imaging surfaces 210, 250 of the first side 300 to be folded to the interior of the pharmacy script for added privacy.

Figure 3B:
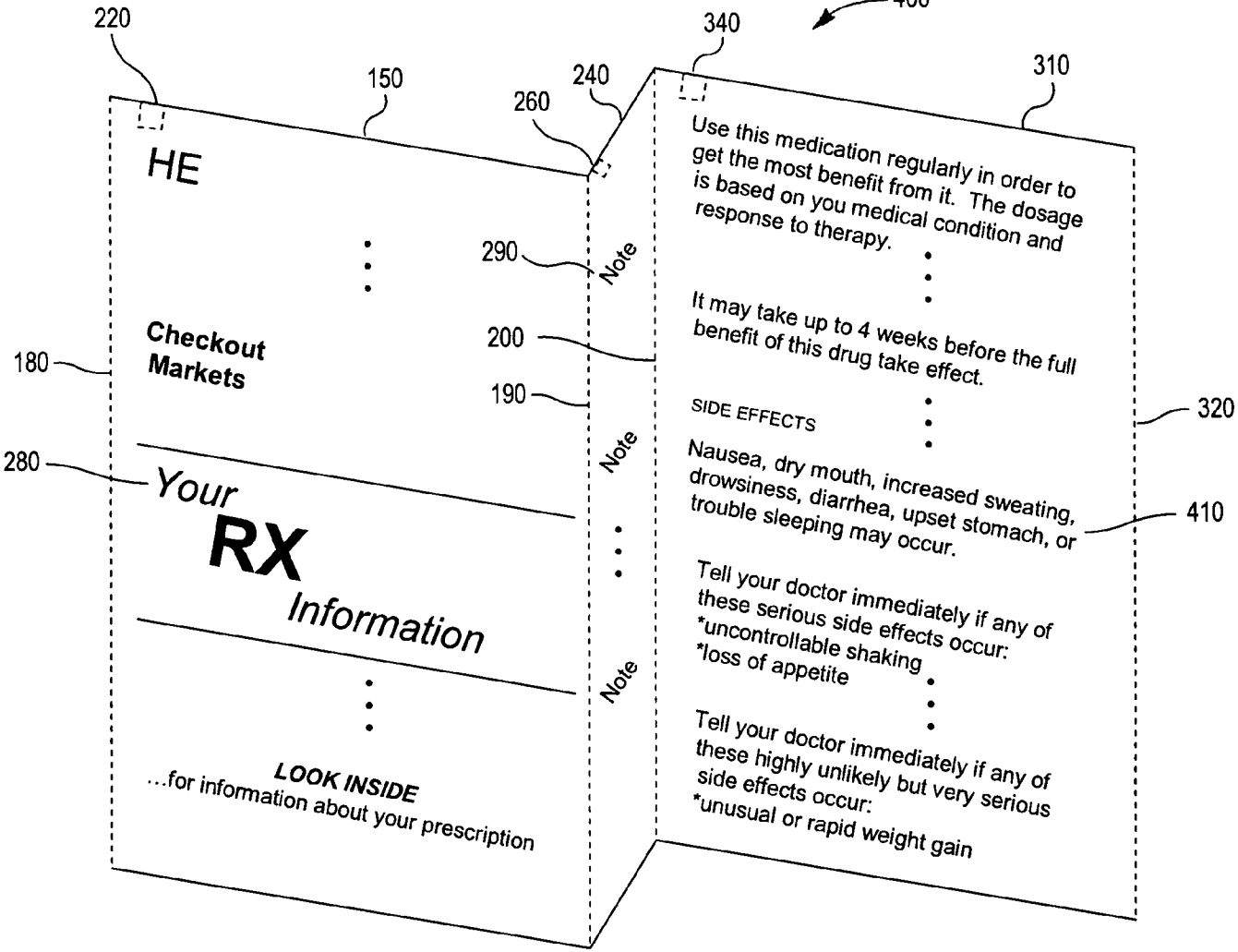

FIG. 3B illustrates an example second reverse side 400 of an example pharmacy script of FIG. 3A printed using the dual-sided imaging direct thermal printer 10 and the dual-sided thermal print media 20, in accordance with FIGS. 1 and 2A-2B. Each of the parts 150, 240 and 310 of the reverse side 400 comprises a respective imaging or printing surface 280, 290 and 410. Each of the printing surfaces 280, 290 and 410 may be imaged or printed with graphics, text and combinations thereof. As described in reference to FIG. 3, a portion of the printed thermal print media 20 may be detached at the last printed part 310 via a cross perforation (or cut) 320 along the width of the lower edge of the last part 310. The detached portion may then be fan-folded along cross perforations 190 and 200 into a pharmacy script. As illustrated in FIG. 3B, the sense marks 220, 260 and 340 are disposed on the first side 300 and are not visible on the second side 400 and sense marks 220 and 260 are fan-folded to the interior once the pharmacy script. As there are an uneven number parts in the example printed pharmacy script, the last sense mark 340 may be visible on the outside of the pharmacy script (first side 300). It should further be noted that any drug-related information that must be concealed in accordance with federal law may be printed or imaged on printing or imaging surfaces 410, 290 of the reverse side 400 to be folded to the interior of the pharmacy script for added privacy.

Further with reference to FIGS. 3A-3B, the imaged or printed graphics and text on the printing surfaces 210, 250, and 330, and 280, 290, and 410, may include prescription information such as drug description, classification, code, dosage, frequency, interaction information, and the like. It may also include patient information such as name, address, phone number, medical or other ID number, and the like. In addition, printed graphics and text may include pictures or other illustrations and/or depictions of the prescribed drug, and/or descriptions of its shape, color, smell, and/or other characteristic identifying the drug, and the like. Further, an image of the patient may be included on the printing surfaces to positively identify the party for whom the pharmacy script is intended, minimizing the risk of misdelivery of the pharmacy script or misadministration of medication. Pricing and/or inventory control information may also be provided on the printing surfaces. Any or all of the above information may further be provided in plain text or graphic form, or otherwise be encoded in, for example, bar code form.

Figure 4:
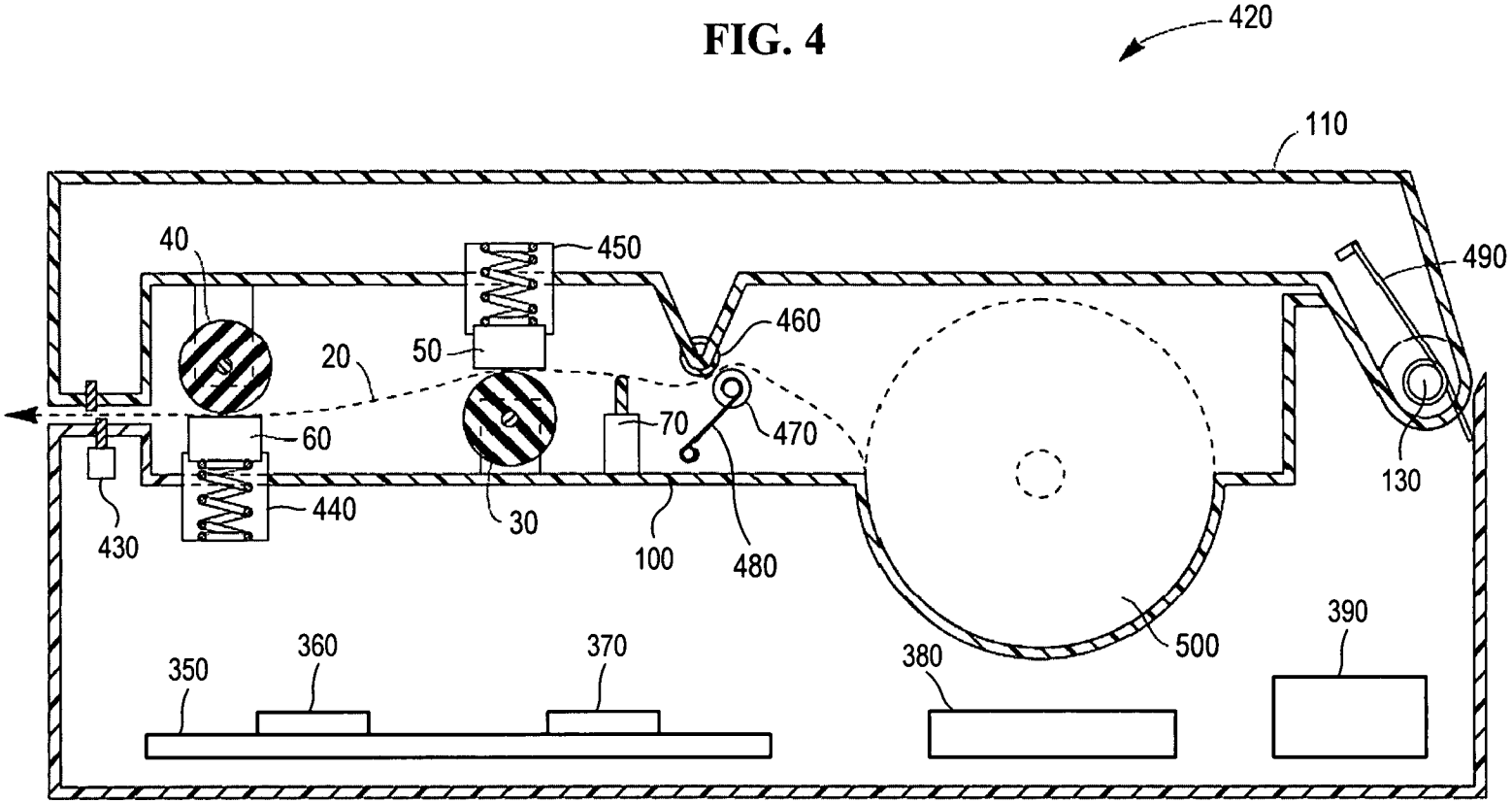
FIG. 4 illustrates a schematic of a partial centerline elevation view of an example dual-sided imaging direct thermal printer in accordance with FIG. 1.

FIG. 4 illustrates a schematic 420 of a partial centerline elevation view of an example dual-sided imaging direct thermal printer in accordance with FIG. 1. Thermal printer 10 comprises first print head 60, first platen 30, sensor 70 and first guide roller 470, all being coupled to a support arm 100 and all being on a first side of the thermal print media 20. The position of the sensor may determined based on design requirements of the thermal printer 10 and thermal media 20. It is noted that the feed path of thermal print media 20 is shown by dashed lines of and an arrow at one end of the thermal print media 20. It is further noted that thermal print media 20 may be drawn from a continuous thermal print media roll 500 housed in the interior of the thermal printer between the first support arm 100 and the second support arm 110. It is to be noted that the print media roll 500 may easily be substituted with a continuous fan-folded print media stack, similarly housed in the interior of the thermal printer 10. The thermal printer 10 further comprises a second print head 50, second platen 40 and second guide roller 460, all being coupled to pivotable support arm 110 and all being on a second (reverse) side of the thermal print media 20. The pivotable support arm 110 pivots about the arm shaft (or hinge) 130 to allow replacement of the thermal print media 20 and servicing of the thermal printer. When pivotable support arm 110 is closed in relation to support arm 100, the thermal print media 20 may be engaged between first print head 60 and opposed second platen 40, between second print head 50 and opposed first platen 30, and between first guide roller 470 and opposed second guide roller 460. Contact pressure with and tension of the thermal print media 20 may be maintained by spring loading second print head 60, first print head 50, and second guide roller 470 with spring mechanisms 440, 450 and 480, respectively. The thermal printer also includes spring 490 that enables the pivotable arm 110 to open at a controlled rate in relation to arm 100, and thereby avoid, for example, uncontrolled closing of the arm 110 through force exerted on the arm 110 via the acceleration of gravity. The thermal printer may also include an electronically activated mechanical cutting mechanism 430 to detach the thermal print media 20 upon completion of a print operation, such as the printing of the pharmacy script. Mechanism 430 may be used to detach a printed portion of the thermal print media 20 along a cross perforation of a last printed part (e.g., see FIGS. 2A-3B).

With further reference to FIG. 4, it is noted that the print heads 50 and 60 are substantially in-line and face substantially opposed directions. As a result, the feed path of thermal print media 20 may be substantially a straight line path given the substantially in-line orientation of the print heads 50 and 60. This configuration facilitates frontal exiting of the thermal print media 20 from the thermal printer. The in-line feed path also facilitates automation of thermal print media 20 replacement and feed, which includes allowing the thermal print media 20 to be automatically drawn from the first print head 60 and second platen 40 through the second print head 50 and first platen 30. Although the in-line orientation of print heads 50 and 60 is described, alternate orientations of the first head 50 in respect to the second print head 60, including varied angle orientations (e.g., 45, 90, 135 and 180 degrees), are possible based on particular design requirements of the thermal printer 10, thermal print media 20 and/or desired media feed path.

Still with further reference to FIG. 4, the thermal printer also comprises control electronics for controlling the operation of the thermal printer. The control electronics may include a motherboard 350, a microprocessor or central processing unit (CPU) 360, and memory 370, such as one or more dynamic random access memory (DRAM) and/or non-volatile random access memory (NVRAM) print buffer memory elements. The thermal printer 10 further comprises a communications controller 380 for communicating with one or more host or auxiliary systems, such as a point-of sale terminal (POS) (not shown) or a computer (not shown) for input of data to and output of data from the thermal printer. Communication controller 380 may support universal serial bus (USB), Ethernet and or wireless communications, among others. The data for printing would typically be supplied by a host POS terminal or a computer communicating with the thermal printer 10 via the communication controller 380. Supplemental data for printing, such as prescribed drug information, safety information and customer information may also be supplied by, for example, a network server (not shown) providing data directly to the thermal printer using the communication controller 380, or indirectly through the host POS terminal or computer. The supplemental data for printing may vary depending upon the identification of the customer and prescribed drug.

Lastly with reference to FIG. 4, memory 370 of the dual-sided direct thermal printer 10 may have a predefined print data storage area to store one or more blocks of predefined print data to be repetitively printed on one or both sides of the print media 20. The blocks of predefined print data may include, for example, a store identifier, a logo, and the like. In addition, the blocks of predefined data may further include legal information such as warranties, disclaimers, return policy, regulatory information, and the like. The predefined print data may be printed along with data submitted by application software associated with the POS terminal or computer on the same or the opposite media side of thermal print media 20. Where multiple data blocks are stored in the predefined print data storage area, the blocks may be alternatively selected for printing through use of a hardware or software switch 390, as may be the location or side of the media on which they are printed, and the like.

Figure 5:
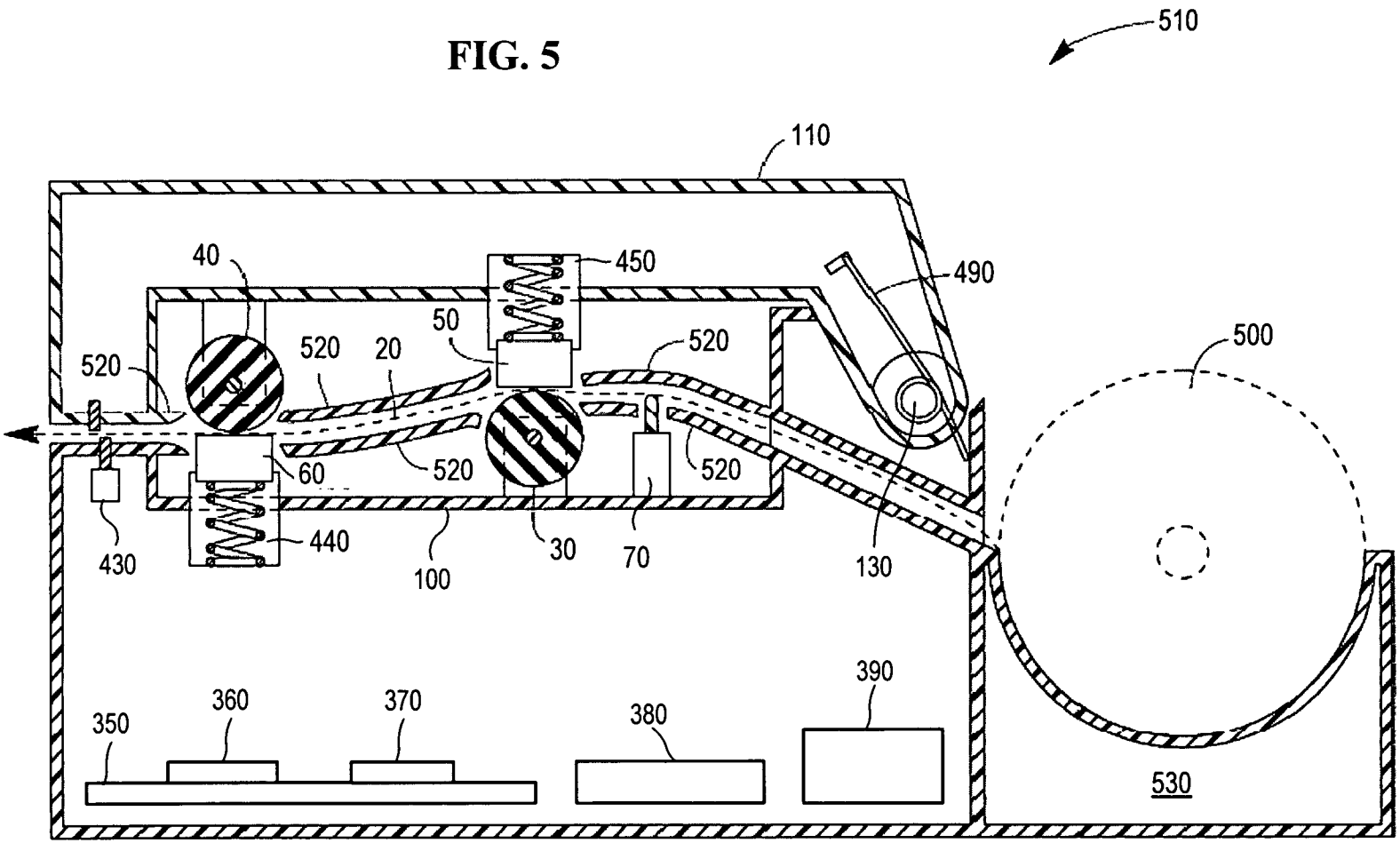
FIG. 5 illustrates another schematic of a partial centerline elevation view of an example dual-sided imaging direct thermal printer in accordance with FIG. 1.

FIG. 5 illustrates another schematic 510 of a partial centerline elevation view of another example dual-sided imaging direct thermal printer in accordance with FIG. 1. In this instance, the thermal printer may be designed to support thermal print media 20, such as a continuous thermal print media roll 500, on the exterior of the thermal printer via roll support 530 for facilitating ready replacement of the continuous thermal print media roll 500 and/or use of greater sizes of the continuous thermal print media roll 500. It is to be noted that continuous print media roll 500 may easily be substituted with a continuous fan-folded print media stack and the roll support 530 may be easily substituted with a stack support. As for the thermal printer illustrated in FIG. 5, the print heads 50 and 60 are substantially in-line and face substantially opposed directions, which provide a substantially in-line feed path that allows automated replacement and loading of thermal print media 20. One or more guides 520 may further be provided to align the thermal print media 20, and thereby facilitate automated loading and feed of the thermal print media 20.

Figure 6:
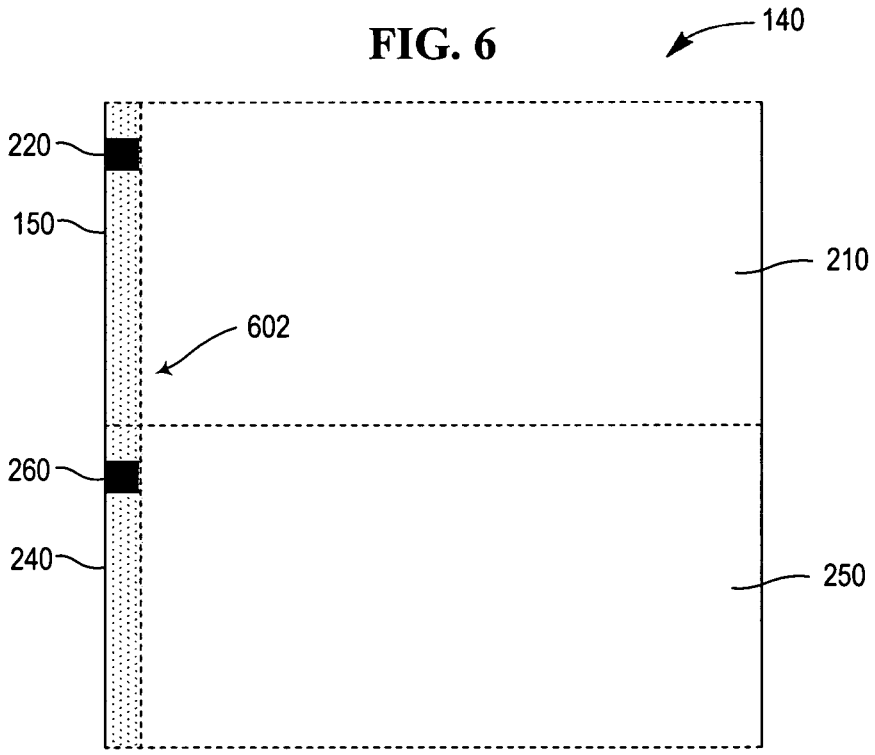
FIG. 6 illustrates an example vertical clear zone scanned by the dual-sided imaging direct thermal printer of FIGS. 1 and 4-5 to detect one or more sense marks in accordance with FIG. 2A.

FIG. 6 illustrates an example vertical clear zone 602 scanned by the dual-sided imaging direct thermal printer of FIGS. 1 and 4-5 to detect one or more sense marks 220, 260 in accordance with FIG. 2A. The vertical clear zone 602 may be stored in memory 370 of the thermal printer and may further be provided to the thermal printer via the communications controller 380 by a host or auxiliary system, such as a point-of sale terminal (POS) (not shown) or a computer (not shown). The predefined vertical clear 602 zone may be adjustable based on particular requirements. The vertical clear zone 602 may be predefined to cover an area where sense marks 220, 260 in accordance with FIG. 2A may be placed on the thermal print media 20 and where the sensor 70 may scan the thermal print media 20 as it may be moved along the feed path. To mitigate interference with detection, there should be no other printing on the thermal print media 20 in the vertical clear zone 602 where the sensor 70 may scan for sense marks 220, 260. However, the sensor 70 and related control electronics may further be enabled to discriminate between sense marks 220, 260 and other printing in the vertical clear zone 602, such as for example, based on size of the sense marks 220, 260 (e.g., width 224, 264 and length 222, 262), their location (e.g., distance 230 from the respective top edge perforations 180 and 190),), and/or other machine readable characteristics (e.g., optical properties, mechanical properties, electrical properties, and the like).

In operation of the thermal printer 10, and in accordance with FIGS. 1-6, the thermal print media 20 may be unrolled from the continuous thermal print media roll 500 or taken from a continuous fan-folded print media stack and may be moved along the feed path toward print heads 50 and 60 for dual-sided imaging, after which it may be outputted to the outside of the thermal printer 10. In a print operation, sensor 70 acquires the predefined vertical clear zone 602 via microprocessor 360 from memory 370 and scans the predefined vertical clear zone 602 to detect a sense mark in accordance with FIG. 2A. When the sensor 70 detects a sense mark in the vertical clear zone 602, such as through detecting its leading edge, trailing edge, width, length, or the like, it sends a signal to microprocessor 360, which utilizes the signal as timing device to control activation of one or more of the print heads 50 and 60 for printing or imaging on a respective side of an individual part of the thermal print media 20 in accordance with FIGS. 2A-3B.

Furthermore, the detection of a sense mark by the sensor 70 may also be used to control the activation of the cutting mechanism 430 to detach the thermal print media 20 upon completion of some or all of the print operation as the thermal print media 20 is output to the outside the thermal printer 10. Activation of the cutting mechanism 430 may be timed to cut the thermal print media 20 at a specified location, such as along a cross perforation 180, 190, 200 or 320 of the thermal print media 20 in accordance with FIGS. 2A-3B. Alternately, activation of the cutting mechanism 430 may be timed to cut the thermal print media 20 at a variable location depending on, for example, the graphic or text information printed or to be printed, or be timed with, for example, completion of all or a portion of a print operation.

In view of the foregoing, a dual-sided thermal media and a dual-sided thermal printer therefor to image documents such as a pharmacy script have been described. The dual sided thermal printer addresses inherent problems associated with printing a pharmacy script using conventional laser printers. The dual sided thermal media printer design for continuous, non-stop thermal media flow coupled with the dual-sided imaging eliminates the double loop commonly used to print a document in duplex mode using a laser printer. The combination of sense marks on the thermal media and one or more sensors in the thermal printer for detecting the sense marks provides excellent control for imagining a document such as the pharmacy script. The format and design of the thermal media, including the sense marks and cross perforations, provide for efficiency and savings in imaging a variable length document, such as the pharmacy script. In regard to the pharmacy script specifically, instead of dealing with several individual pages in a laser-printed process fraught with the possibility of misplacing pages, the example embodiments provide for a continuous fan-folded pharmacy script that is easy to handle, covers confidential information that must legally be concealed, and can be conveniently attached to a prescription package.

The above description is illustrative, and not restrictive. Many other embodiments will be apparent to those of skill in the art upon reviewing the above description. The scope of embodiments should therefore be determined with reference to the appended claims, along with the full scope of equivalents to which such claims are entitled.

The Abstract is provided to comply with 37 C.F.R. §1.72(b) and will allow the reader to quickly ascertain the nature and gist of the technical disclosure. It is submitted with the understanding that it will not be used to interpret or limit the scope or meaning of the claims.

In the foregoing description of the embodiments, various features are grouped together in a single embodiment for the purpose of streamlining the description. This method of disclosure is not to be interpreted as reflecting that the claimed embodiments have more features than are expressly recited in each claim. Rather, as the following claims reflect, inventive subject matter lies in less than all features of a single disclosed embodiment. Thus the following claims are hereby incorporated into the Detailed Description, with each claim standing on its own as a separate example embodiment.

What is claimed is:

1. A method for imaging a dual-sided thermal media, the method comprising:

detecting one or more sense marks disposed on the thermal media;

controlling activation of one or more of a first print head and a second print head to image a respective one or more of a first side and a second side of the thermal media based on the detection; and predefining vertical clear zone that covers an area of the thermal media where the one or more sense marks are disposed on the thermal media.

2. The method for imaging a dual-sided thermal media in accordance with claim 1, further comprising scanning the predefined vertical clear zone to detect the one or more sense marks disposed on the thermal media.

3. A method for imaging a dual-sided thermal media, the method comprising:

detecting one or more sense marks disposed on the thermal media; and controlling activation of one or more of a first print head and a second print head to image a respective one or more of a first side and a second side of the thermal media based on the detection;

wherein the thermal media comprises a plurality of successive parts of a predetermined length and a predetermined width, with each successive part of the plurality of parts including a sense mark disposed at a predetermined location of the respective part.

4. The method for imaging a dual-sided thermal media in accordance with claim 3, wherein the plurality of successive parts is delineated by cross perforations along the predetermined width.

5. The method for imaging a dual-sided thermal media in accordance with claim 4, further comprising:

receiving a detection signal for a detected sense mark associated with a last part of the thermal media imaged; and activating a cutting mechanism to detach the thermal media along a cross perforation after the last part of thermal media imaged on the basis of the received detection signal to form a document.

6. The method for imaging a dual-sided thermal media in accordance with claim 5, further comprising fan-folding the document along the cross perforations.

7. The method for imaging a dual-sided thermal media in accordance with claim 5, wherein the document is a pharmacy script.

8. A dual-sided direct thermal printer comprising:

a first print head positioned proximate to a first platen;

a second print head positioned proximate to a second platen, the first print head being in a substantially opposed relation to the second platen and the second print head being in a substantially opposed relation to the first platen;

a sensor adapted to detect one or more sense marks disposed on a thermal media and to control activation of one or more of the first print head and the second print head to image the thermal media based on the detection; and a memory adapted to store a predefined vertical clear zone that covers an area of the thermal media where the one or more sense marks are disposed on the thermal media.

9. The dual-sided direct thermal printer in accordance with claim 8, further comprising a microprocessor adapted to:

receive a detection signal from the sensor for each detected sense mark of the one or more sense marks; and activate one or more of the first print head and the second print head to image the thermal media on the basis of the received detection signal.

10. The dual-sided direct thermal printer in accordance with claim 8, wherein the sensor scans the predefined vertical clear zone to detect the one or more sense marks disposed on the thermal media.

11. The dual-sided direct thermal printer in accordance with claim 9, wherein the thermal media comprises a plurality of successive parts of a predetermined length and a predetermined width, with each successive part of the plurality of parts including a sense mark disposed at a predetermined location of the respective part.

12. The dual-sided direct thermal printer in accordance with claim 11, wherein the plurality of successive parts is delineated by cross perforations along the predetermined width.

13. The dual-sided direct thermal printer in accordance with claim 12, further comprising a cutting mechanism adapted to detach the thermal media along a cross perforation.

14. The dual-sided direct thermal printer in accordance with claim 13, wherein the microprocessor is further adapted to:

receive a detection signal from the sensor for a detected sense mark; and activate the cutting mechanism to detach the thermal media along the cross perforation after the last part of thermal media imaged on the basis of the received detection signal to form a document.

15. The dual-sided direct thermal printer in accordance with claim 14, wherein the document is a pharmacy script.

16. The dual-sided direct thermal printer in accordance with claim 9, further comprising a cutting mechanism adapted to detach the thermal media, wherein the microprocessor is further adapted to:

receive a detection signal from the sensor for a detected sense mark; and activate the cutting mechanism to detach the thermal media on the basis of the received detection signal.

17. A thermal media for dual-sided imaging, the thermal media comprising:

a plurality of successive parts of a predetermined length and a predetermined width, the successive parts delineated by a plurality of cross perforations along the predetermined width; and a plurality of sense marks, each of the plurality of sense marks disposed at a predetermined location of a respective part of the plurality of successive parts, wherein a predetermined number of the plurality of successive parts is imaged and detached along a cross perforation after a last part of the imaged parts to form a document.

18. The thermal media for dual-sided imaging in accordance with claim 17, wherein the document is fan-folded along the cross perforations.

19. The thermal media for dual-sided imaging in accordance with claim 17, wherein the document is a pharmacy script.

20. The thermal media for dual-sided imaging in accordance with claim 17, wherein the plurality of sense marks has a predetermined length and a predetermined width.

21. The thermal media for dual-sided imaging in accordance with claim 20, wherein each sense mark of the plurality of sense marks is disposed about an edge along the predetermined length on the respective part of the plurality of successive parts.

22. A dual-sided direct thermal printing system, the system comprising:

a thermal media for dual-sided imaging including:

a plurality of successive parts of a predetermined length and a predetermined width, the successive parts delineated by a plurality of cross perforations along the predetermined width; and a plurality of sense marks, each of the plurality of sense marks disposed at a predetermined location of a respective part of the plurality of successive parts; and a dual-sided thermal printer including:

a first print head positioned proximate to a first platen;

a second print head positioned proximate to a second platen, the first print head being in a substantially opposed relation to the second platen and the second print head being in a substantially opposed relation to the first platen; and a sensor adapted to detect the plurality of sense marks disposed on the thermal media and to control activation of one or more of the first print head and the second print head to image one or more of the successive parts of the thermal media based on the detection.

23. The dual-sided direct thermal printing system in accordance with claim 22, wherein the thermal printer further comprises a microprocessor adapted to:

receive a detection signal from the sensor for each detected sense mark of the plurality of sense marks; and activate one or more of the first print head and the second print head to image the one or more of the successive parts of the thermal media on the basis of the received detection signal.

24. The dual-sided direct thermal printing system in accordance with claim 22, wherein the thermal printer further comprises a memory adapted to store a predefined vertical clear zone that covers an area of the thermal media where the plurality of sense marks are disposed on the thermal media.

25. The dual-sided direct thermal printing system in accordance with claim 24, wherein the sensor scans the predefined vertical clear zone to detect the plurality of sense marks disposed on the thermal media.

26. The dual-sided direct thermal printing system in accordance with claim 23, wherein the thermal printer further comprises a cutting mechanism adapted to detach the thermal media along the a cross perforation of the plurality of cross perforations.

27. The dual-sided direct thermal printing system in accordance with claim 26, wherein the microprocessor is further adapted to:

receive a detection signal from the sensor for a detected sense mark associated with a last part of the thermal media imaged; and activate the cutting mechanism to detach the thermal media along the cross perforation after the last part of thermal media imaged on the basis of the received detection signal to form a document.

28. The dual-sided direct thermal printing system in accordance with claim 27, wherein the document is pharmacy script.

29. The dual-sided direct thermal printing system in accordance with claim 23, wherein the thermal printer further comprises a cutting mechanism adapted to detach the thermal media and wherein the microprocessor is further adapted to:

receive a detection signal from the sensor for a detected sense mark; and activate the cutting mechanism to detach the thermal media on the basis of the received detection signal.

30. The dual-sided direct thermal printing system in accordance with claim 22, wherein the predetermined length of the plurality of successive parts of the thermal media is from about 3 inches to 14 inches.

31. The dual-sided direct thermal printing system in accordance with claim 22, wherein the predetermined width of the plurality of successive parts of the thermal media is from about 3 inches to about 8½ inches.

32. The dual-sided direct thermal printing system in accordance with claim 22, wherein the predetermined length of the plurality of successive parts of the thermal media is about 5½ inches and the predetermined width is about 8½ inches.

33. The dual-sided direct thermal printing system in accordance with claim 22, wherein the plurality of sense marks of the thermal media has a predetermined length and a predetermined width.

34. The dual-sided direct thermal printing system in accordance with claim 33, wherein the predetermined length of the plurality of sense marks is from about 0.1 of an inch to about ¼ of an inch.

35. The dual-sided direct thermal printing system in accordance with claim 33, wherein the predetermined width of the plurality of sense marks is from about 0.1 of an inch to about 1 inch.

36. The dual-sided direct thermal printing system in accordance with claim 33, wherein the predetermined length of the plurality of sense marks is about ¼ of an inch and the predetermined width is about ¼ of an inch.

37. The dual-sided direct thermal printing system in accordance with claim 22, wherein each sense mark of the plurality of sense marks is disposed about an edge along the predetermined length on the respective part of the plurality of successive parts of the thermal paper.

38. The dual-sided direct thermal printing system in accordance with claim 37, wherein each sense mark of the plurality of sense marks is disposed about ¼ of an inch below a cross perforation of the plurality of cross perforations on the respective part of the plurality of successive parts of the thermal paper.

* * * * *